US007740484B1

(12) United States Patent
Chiang

(10) Patent No.: US 7,740,484 B1
(45) Date of Patent: Jun. 22, 2010

(54) ROTATABLE RECEPTACLE

(75) Inventor: Yi-Te Chiang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/426,849

(22) Filed: Apr. 20, 2009

(30) Foreign Application Priority Data

Feb. 13, 2009 (TW) ..... 98104587 A

(51) Int. Cl.
*H01R 39/00* (2006.01)

(52) U.S. Cl. ..... 439/13

(58) Field of Classification Search ..... 439/13, 439/11, 18–28, 158, 15
See application file for complete search history.

(56) References Cited

U.S. PATENT DOCUMENTS 5,422,957 A * 6/1995 Cummins ..... 381/384
7,255,568 B1 * 8/2007 Wu ..... 439/23
7,296,775 B2 * 11/2007 Mayer ..... 248/349.1
7,488,178 B2 * 2/2009 Inotsuka ..... 439/15
7,497,707 B2 * 3/2009 Wu et al. ..... 439/172
7,544,063 B2 * 6/2009 Puskar et al. ..... 439/13
7,575,436 B1 * 8/2009 Devlin et al. ..... 439/21

* cited by examiner

*Primary Examiner*—Jean F Duverne
(74) *Attorney, Agent, or Firm*—Kirton & McConkie; Evan R. Witt

(57) ABSTRACT

A rotatable receptacle includes a rotary member, a power cord and a fixing stand. The rotary member is fixed by the fixing stand. The fixing stand is electrically connected to the rotary member and the power cord. The rotary member includes multiple conductor terminals, which are arranged at different rotating tracks. The fixing stand includes multiple conductor slices. The conductor slices have respective ring-shape contact regions of different size. When the rotary member is rotated with respect to the fixing stand, the conductor terminals of the rotary member are continuously electrically with corresponding ring-shape contact regions of the fixing stand.

20 Claims, 7 Drawing Sheets

ROTATABLE RECEPTACLE

FIELD OF THE INVENTION

The present invention relates to a receptacle, and more particularly to a rotatable receptacle.

BACKGROUND OF THE INVENTION

The general power receptacles are fixed receptacles because they are usually mounted on walls or partitions or arranged within furniture. In addition, the common extension cord receptacles are also fixed receptacles. As known, the positions of the insertion holes of the fixed receptacles are fixed and fail to be changed. Since the positions of the insertion holes are fixed, the plug can only be inserted to receptacle in specified directions. In some situations, the power cord that is connected to the plug needs to be bent. If the power receptacle has been used for a long term, the power cord is readily detached or fractured. Moreover, when a plug of a large-size connector (e.g. a linear adapter) is inserted into the fixed receptacle, the neighboring fixed receptacle is usually hindered by the large-size connector because the width of such connector is larger than the distance between two adjacent fixed receptacles.

SUMMARY OF THE INVENTION

As previously described, the conventional fixed receptacle is not rotatable. It is an object of the present invention to provide a rotatable receptacle so as to obviate the drawbacks encountered from the prior art.

In accordance with an aspect of the present invention, there is provided a rotatable receptacle. The rotatable receptacle includes a rotary member, a power cord and a fixing stand. The rotary member includes an outer cover, a bottom cover, a first conductor terminal, a second conductor terminal, and a third conductor terminal. The outer cover includes a faceplate side and an internal side. The faceplate side includes a first insertion hole, a second insertion hole and a third insertion hole. The internal side includes a first recess, a second recess and a third recess. The first insertion hole is communicated with the first recess. The second insertion hole is communicated with the second recess. The third insertion hole is communicated with the second recess. The bottom cover is fixed onto the internal side of the outer cover, and includes a first perforation, a second perforation and a third perforation. The bottom cover has a protruding edge on a periphery thereof. The first conductor terminal is arranged between the outer cover and the bottom cover, and includes a first contact slice and a first resilient sustaining slice. The first contact slice is inserted into the first recess. The first resilient sustaining slice is penetrated through the perforation and protruded out of the bottom cover. The second conductor terminal is arranged between the outer cover and the bottom cover, and includes a second contact slice and a second resilient sustaining slice. The second contact slice is inserted into the second recess. The second resilient sustaining slice is penetrated through the perforation and protruded out of the bottom cover. The third conductor terminal is arranged between the outer cover and the bottom cover, and includes a third contact slice and a fourth contact slice. The third contact slice is inserted into the third recess. The power cord includes a first polarity wire, a second polarity wire and a third polarity wire. The fixing stand includes a side wall, a bottom surface, a first conductor slice, a second conductor slice, and a fourth conductor terminal. The side wall has a hooking element engaged with the protruding edge of the bottom cover, so that the rotary member is rotatable with respect to the fixing stand. The bottom surface has a fourth insertion hole. The first conductor slice is electrically connected with the first polarity wire, and includes a fourth perforation and a first ring-shape contact region. The first ring-shape contact region is contacted with the first resilient sustaining slice. The second conductor slice is electrically connected with the second polarity wire, accommodated within the fourth perforation, and includes a fifth perforation and a second ring-shape contact region. The second ring-shape contact region is contacted with the second resilient sustaining slice. The fourth conductor terminal is accommodated within the fifth perforation, and includes a conductive end and an inserting slice. The conductive end is electrically connected to the fourth contact slice. The inserting slice is penetrated through the fourth insertion hole and protruded out of the fixing stand to be electrically connected with the third polarity wire.

In an embodiment, the conductive end of the fourth conductor terminal is connected with the fourth contact slice of the third conductor terminal through a rivet.

In an embodiment, the fourth contact slice of the third conductor terminal is formed as a clamp, and the conductive end of the fourth conductor terminal is formed as a conductive rod, which is penetrated through the third perforation and inserted into the clamp.

In an embodiment, the protruding edge is a ring-shaped protruding structure.

In an embodiment, the protruding edge includes multiple annularly-arranged protruding structures.

In an embodiment, the rotatable receptacle further includes a stud, a fastening hole and a screw. The stud is formed on the internal side of the outer cover. The fastening hole is formed in the bottom cover. The screw penetrates through the fastening hole and tightens in the stud, thereby fixing the bottom cover onto the internal side of the outer cover.

In an embodiment, the bottom surface of the fixing stand further includes a first concave region and a second concave region. The first conductor slice is accommodated in the first concave region. The second conductor slice is accommodated in the second concave region.

In an embodiment, the bottom surface of the fixing stand further includes a sixth perforation and a seventh perforation. The first polarity wire is penetrated through the sixth perforation and electrically connected with the first conductor slice. The second polarity wire is penetrated through the seventh perforation and electrically connected with the second conductor slice.

In an embodiment, the first polarity wire is selected from one of a live wire, a neutral wire and an earth wire.

In an embodiment, the second polarity wire is selected from one of a live wire, a neutral wire, and an earth wire.

In an embodiment, the third polarity wire is selected from one of a live wire, a neutral wire, and an earth wire.

In an embodiment, partial surface of the first conductor slice is formed as the first ring-shape contact region, and partial surface of the second conductor slice is formed as the second ring-shape contact region.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
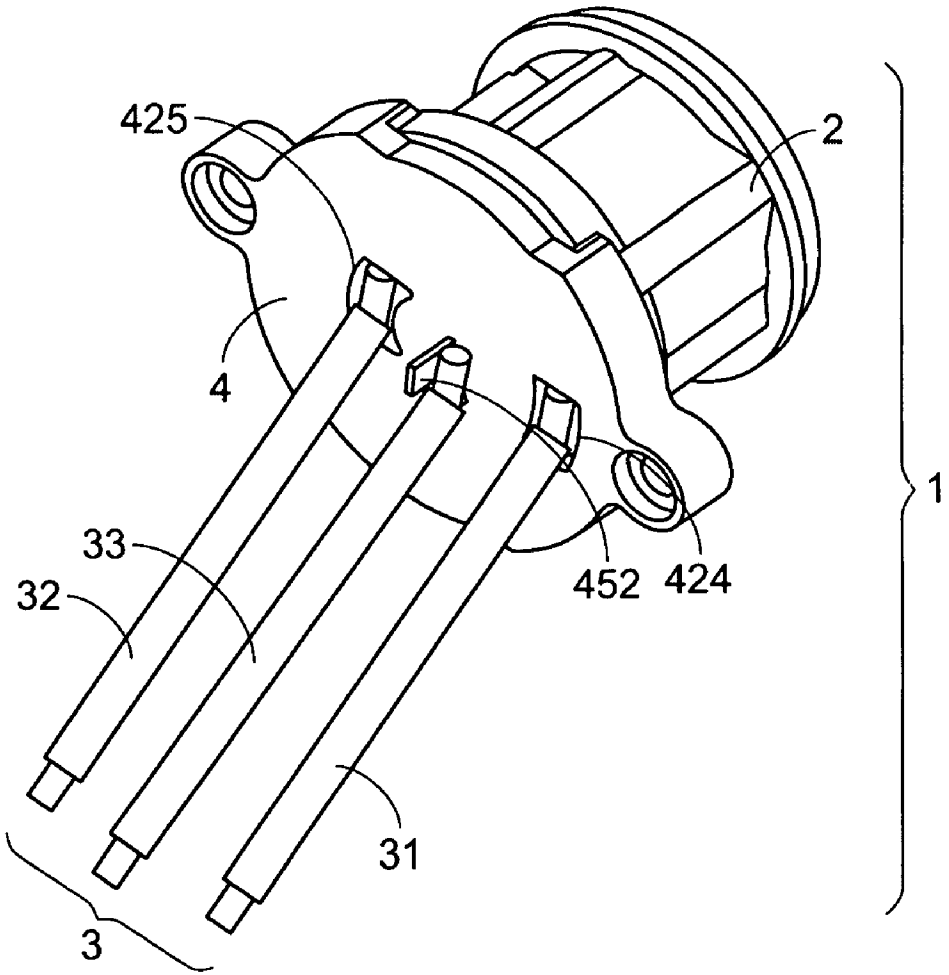
FIG. 1 is a schematic assembled view illustrating a rotatable receptacle according to an embodiment of the present invention.
Figure 2:
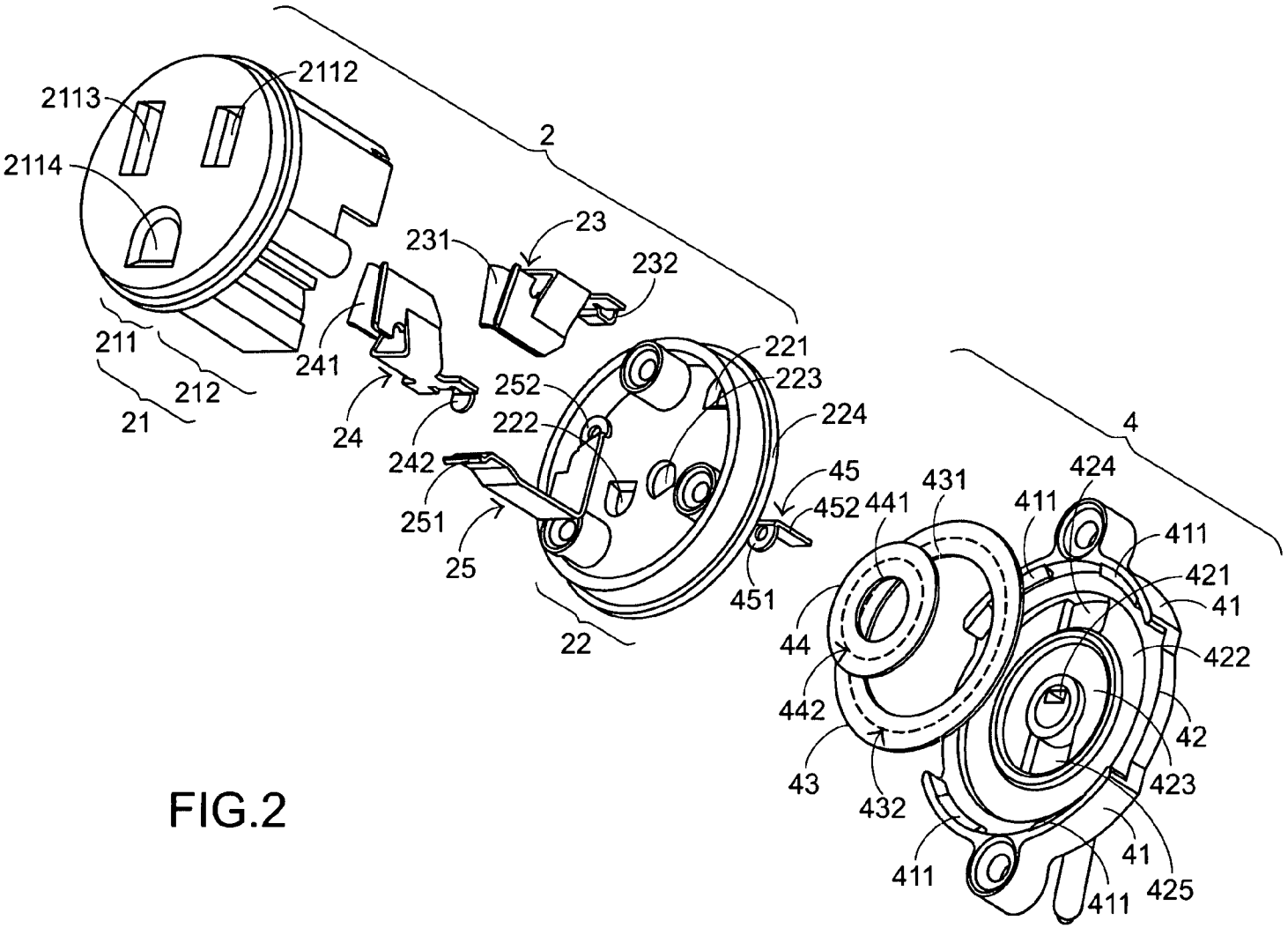
FIG. 2 is a schematic exploded view of the rotatable receptacle according to the embodiment of the present invention.

FIG. 1 is a schematic assembled view illustrating a rotatable receptacle according to an embodiment of the present invention. FIG. 2 is a schematic exploded view of the rotatable receptacle according to the embodiment of the present invention. As shown in FIGS. 1 and 2, the rotatable receptacle 1 principally comprises a rotary member 2, a power cord 3 and a fixing stand 4. The detailed structures of the rotary member 2, the power cord 3 and the fixing stand 4 will be illustrated in more details as follows.

Figure 3:
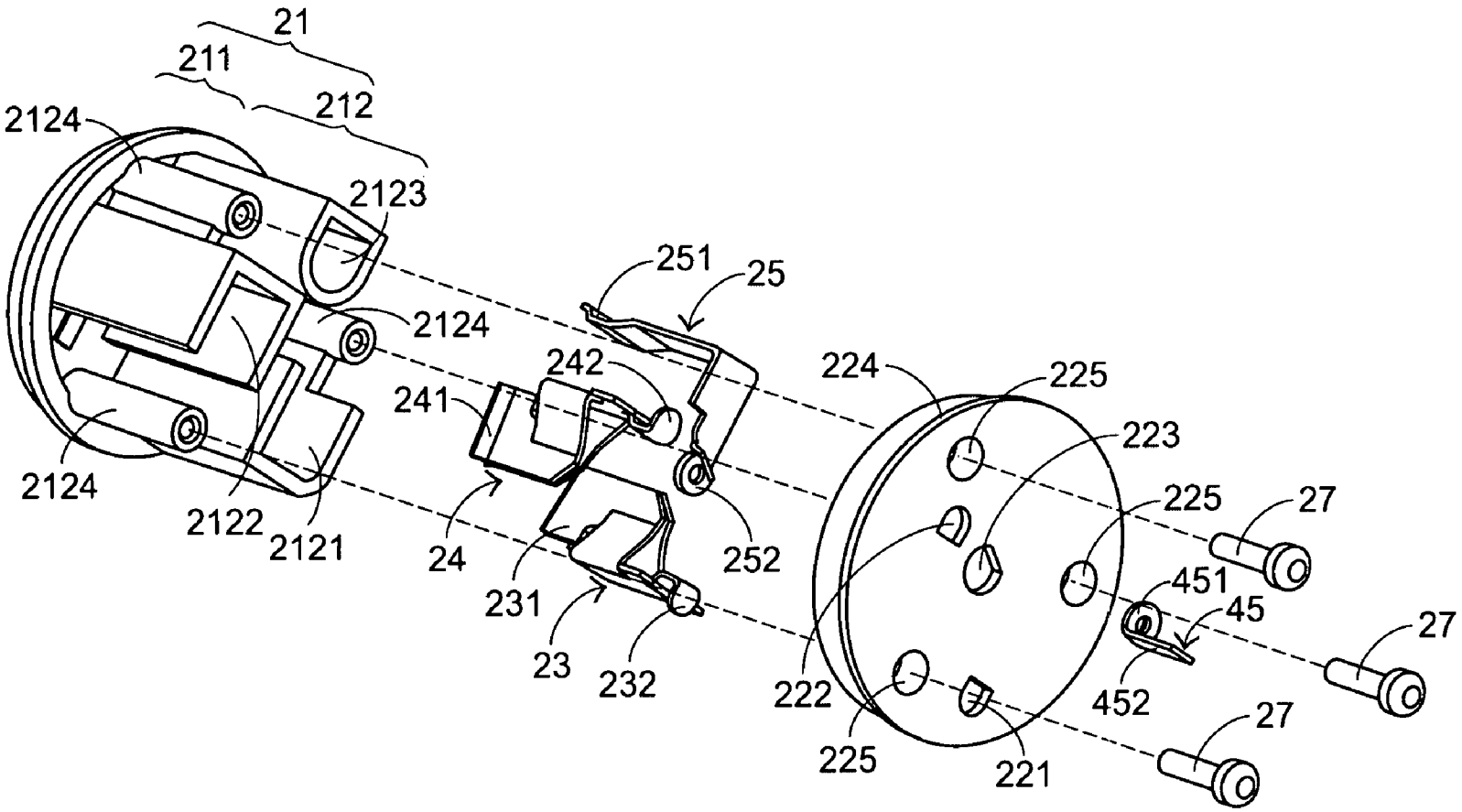
FIG. 3 is a schematic exploded view illustrating the rotary member of the rotatable receptacle according to the embodiment of the present invention.

FIG. 3 is a schematic exploded view illustrating the rotary member of the rotatable receptacle according to the embodiment of the present invention. The drawings of FIG. 2 and FIG. 3 are taken from different viewpoints. The rotary member 2 includes an outer cover 21, a bottom cover 22, and several conductor terminals 23, 24 and 25. The outer cover 21 has a faceplate side 211 and an internal side 212. The faceplate side 211 includes several insertion holes 2112, 2113 and 2114. The internal side 212 includes several recesses 2121, 2122 and 2123. The insertion hole 2112 is communicated with the recess 2121. The insertion hole 2113 is communicated with the recess 2122. The insertion hole 2114 is communicated with the recess 2123. The bottom cover 22 is fixed onto the internal side 212 of the outer cover 21. The bottom cover 22 includes several perforations 221, 222 and 223. In addition, the bottom cover 22 has a protruding edge 224 on a periphery thereof. As shown in FIG. 2, the protruding edge 224 includes a ring-shaped protruding structure. In some embodiments, the protruding edge 224 includes multiple annularly-arranged protruding structures (not shown). The conductor terminal 23 is arranged between the outer cover 21 and the bottom cover 22. The conductor terminal 23 includes a contact slice 231 and a resilient sustaining slice 232. The contact slice 231 is inserted into the recess 2121. The resilient sustaining slice 232 is penetrated through the perforation 221 of the bottom cover 22 and protruded out of the bottom cover 22. The conductor terminal 24 is arranged between the outer cover 21 and the bottom cover 22. The conductor terminal 24 includes a contact slice 241 and a resilient sustaining slice 242. The contact slice 241 is inserted into the recess 2122. The resilient sustaining slice 242 is penetrated through the perforation 222 of the bottom cover 22 and protruded out of the bottom cover 22. The conductor terminal 25 is also arranged between the outer cover 21 and the bottom cover 22. The conductor terminal 25 includes a contact slice 251 and another contact slice 252. The contact slice 251 is inserted into the recess 2123.

Please refer to the perspective view of the rotatable receptacle 1 of FIG. 1 again. The power cord 3 includes a first polarity wire 31, a second polarity wire 32 and a third polarity wire 33. The first polarity wire 31 is selected from one of a live wire, a neutral wire and an earth wire. The second polarity wire 32 is selected from one of a live wire, a neutral wire and an earth wire, wherein the second polarity wire 32 is different from the first polarity wire 31. The third polarity wire 33 is selected from one of a live wire, a neutral wire and an earth wire, wherein the third polarity wire 33 is different from the first polarity wire 31 or the second polarity wire 32. In an embodiment of the rotatable receptacle of the present invention, the first polarity wire 31 is a live wire, the second polarity wire 32 is a neutral wire, and the third polarity wire 33 is an earth wire.

Please refer to the assembled view and the exploded view of the rotatable receptacle 1 as shown in FIGS. 1 and 2 again. The fixing stand 4 includes a side wall 41, a bottom surface 42, two conductor slices 43 and 44, and a conductor terminal 45. The side wall 41 has a hooking element 411 corresponding to the protruding edge 224 of the bottom cover 22. After the hooking element 411 is engaged with the protruding edge 224 of the bottom cover 22, the rotary member 2 can be rotated with respect to the fixing stand 4. The bottom surface 42 includes an insertion hole 421 and two perforations 424 and 425. A portion of the conductor terminal 45 is penetrated through the insertion hole 421 so as to be electrically connected with the third polarity wire 33 that is disposed outside the fixing stand 4. The conductor slice 43 includes a perforation 431 and a ring-shape contact region 432. The ring-shape contact region 432 is contacted with the resilient sustaining slice 232. After the first polarity wire 31 is penetrated through the perforation 424 of the bottom surface 42, the first polarity wire 31 is soldered on the conductor slice 43 such that the first polarity wire 31 is electrically connected with the conductor slice 43. The conductor slice 44 is accommodated within the perforation 431. The conductor slice 44 includes a perforation 441 and a ring-shape contact region 442. The ring-shape contact region 442 is contacted with the resilient sustaining slice 242. After the second polarity wire 32 is penetrated through the perforation 425 of the bottom surface 42, the second polarity wire 32 is soldered on the conductor slice 44 such that the second polarity wire 32 is electrically connected with the conductor slice 44. The conductor terminal 45 is accommodated within the perforation 441. The conductor terminal 45 includes a conductive end 451 and an inserting slice 452. The conductive end 451 is electrically connected to the contact slice 252 of the conductor terminal 25. The inserting slice 452 is penetrated through the insertion hole 421 of the bottom surface 42 and protruded out of the fixing stand 4. After the inserting slice 452 is penetrated through the insertion hole 421, the third polarity wire 33 is soldered on the inserting slice 452 such that the third polarity wire 33 is electrically connected with the inserting slice 452.

Figure 4A:
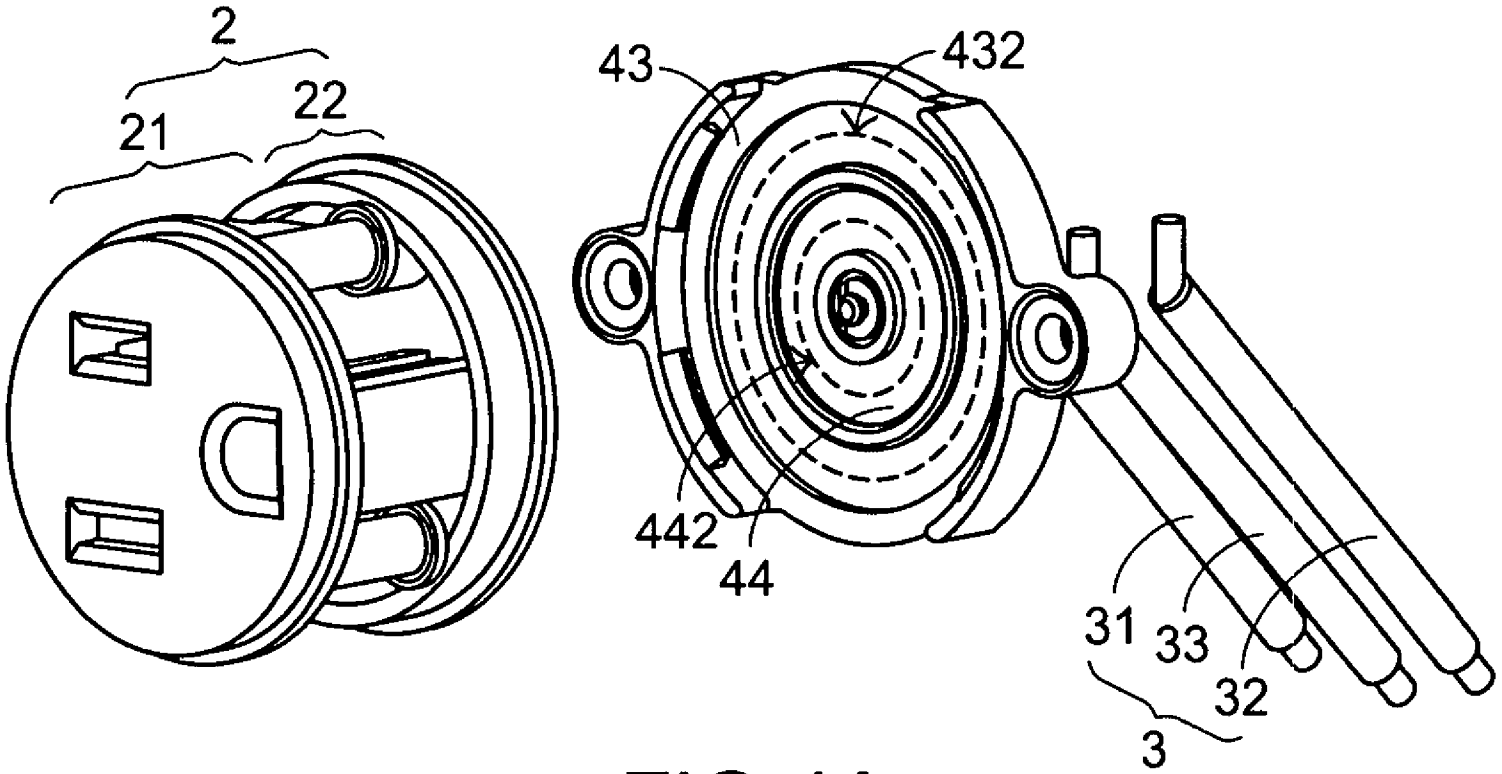
FIG. 4A is a schematic perspective view illustrating the rotary member, the power cord and the fixing stand of the rotatable receptacle according to the embodiment of the present invention.
Figure 4B:
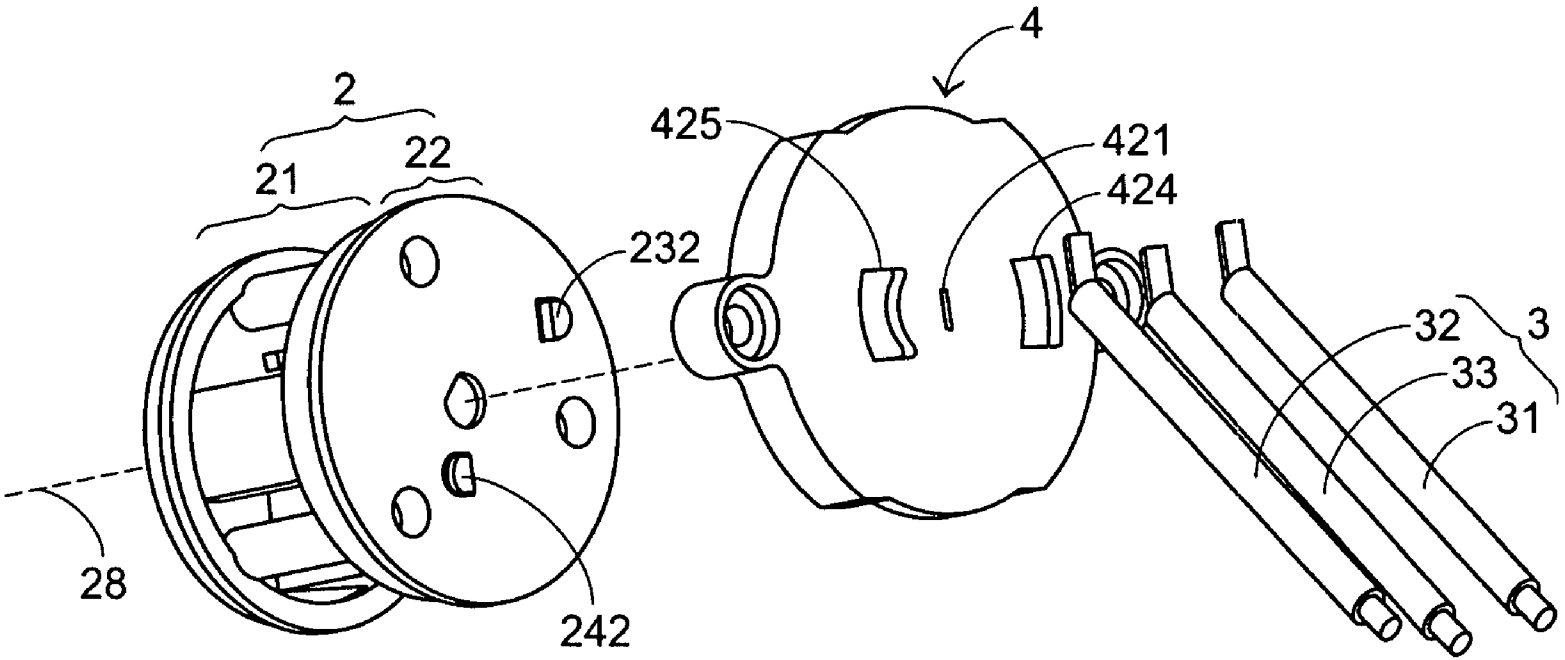
FIG. 4B is a schematic perspective view of the rotatable receptacle shown in FIG. 4A and taken from a different viewpoint.

FIG. 4A is a schematic perspective view illustrating the rotary member, the power cord and the fixing stand of the rotatable receptacle according to the embodiment of the present invention. FIG. 4B is a schematic perspective view of the rotatable receptacle shown in FIG. 4A and taken from a different viewpoint. Please refer to FIG. 2, FIG. 4A and FIG. 4B. In this embodiment, the bottom surface 42 of the fixing stand 4 further includes two concave regions 422 and 423. The concave regions 422 and 423 respectively mate with the conductor slices 43 and 44 in their sizes. The perforation 424 is formed in the concave region 422. The perforation 425 is formed in the concave region 423. After the conductor slices 43 and 44 are respectively accommodated within the concave regions 422 and 423 (as shown in FIG. 4A), the first polarity wire 31 and the second polarity wire 32 that have been penetrated through the perforations 424 and 425 can be more easily soldered on and electrically connected with the conductor slices 43 and 44 (as shown in FIG. 4B). As shown in FIG. 2, the conductor slices 43 and 44 are ring-shaped. The shapes of the conductor slices 43 and 44 are not restricted as long as partial surfaces of the conductor slices 43 and 44 are formed as the ring-shape contact regions 432 and 442. Under this circumstance, the resilient sustaining slice 232 of the conductor terminal 23 and the resilient sustaining slice 242 of the conductor terminal 24 will be electrically connected with the conductor slices 43 and 44 without difficulty.

Please refer to the schematic exploded view of the rotary member 2 of the rotatable receptacle 1 as shown in FIG. 3 again. In this embodiment, several studs 2124 are formed on the internal side 212 of the outer cover 21. Corresponding to the studs 2124, several fastening holes 225 are formed in the bottom cover 22. By penetrating screws 27 through the fastening holes 225 of the bottom cover 22 and then tightening the screws 27 in the studs 2124, the bottom cover 22 is fixed onto the internal side 212 of the outer cover 21. At the same time, the conductor terminals 23, 24 and 25 are respectively fixed within the recesses 2121, 2122 and 2123 of the outer cover 21, thereby assembling the rotary member 2.

Please refer to FIGS. 4A and 4B again. After the protruding edge 224 of the bottom cover 22 is engaged with the hooking element 411 of the fixing stand 4, the rotary member 2 can be freely rotated with respect to the fixing stand 4. Since the resilient sustaining slice 232 of the conductor terminal 23 and the resilient sustaining slice 242 of the conductor terminal 24 are exposed outside the bottom cover 22, the resilient sustaining slices 232 and 242 are respectively sustained against the conductor slices 43 and 44 after the rotary member 2 is combined with the fixing stand 4. Moreover, during the process of freely rotating the rotary member 2, the resilient sustaining slices 232 and 242 are all the time in electrical connection with the ring-shape contact region 432 of the conductor slice 43 and the ring-shape contact region 442 of the conductor slice 44, respectively.

Figure 5B:
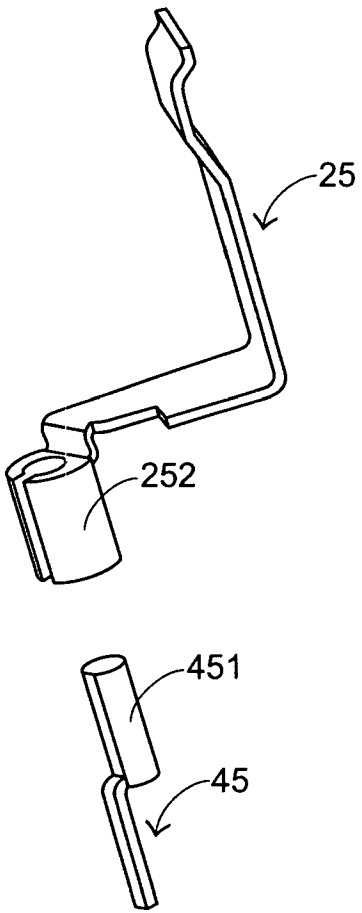
FIG. 5B is a schematic perspective view illustrating a conductor terminal of the rotary member and a corresponding conductor terminal of the fixing stand according to an variant of the present invention.
Figure 5A:
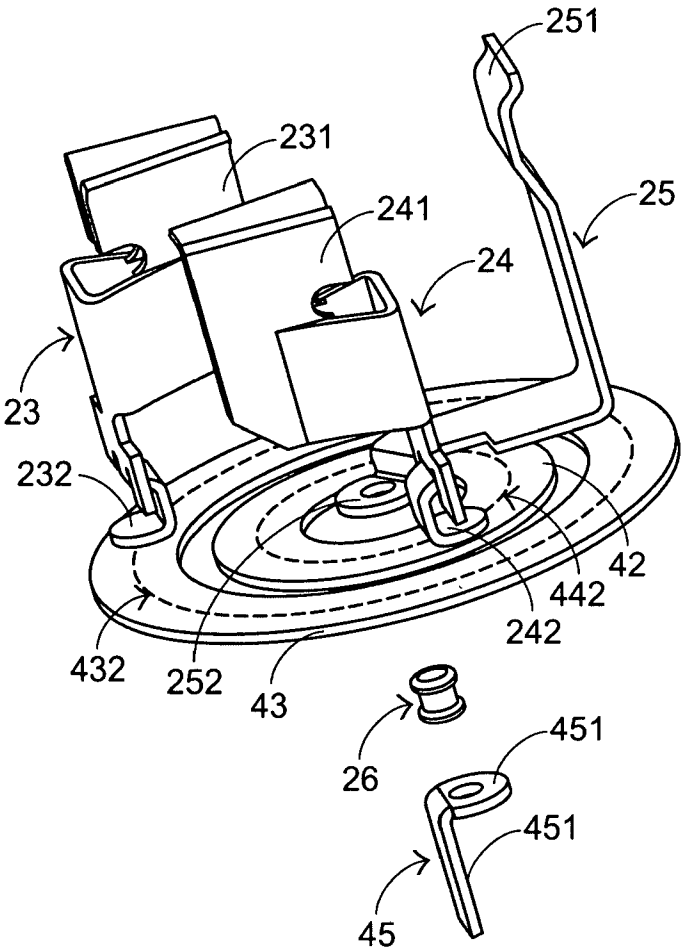
FIG. 5A is a schematic perspective view illustrating the relative positions of the conductor terminals of the rotary member and the conductor slices and terminals of the fixing stand.

FIG. 5A is a schematic perspective view illustrating the relative positions of the conductor terminals 23, 24 and 25 of the rotary member 2 and the conductor slices 43, 44 and 45 of the fixing stand 4. In this embodiment, the resilient sustaining slice 232 of the conductor terminal 23 and the resilient sustaining slice 242 of the conductor terminal 24 are bow-shaped. Due to the bow-shapes of the resilient sustaining slices 232 and 242, the resilient sustaining slices 232 and 242 can be continuously in contacted with the conductor slices 43 and 44 without the needs of using additional resilient elements (e.g. springs) to suppress the resilient sustaining slices 232 and 242 to be contacted with the conductor slices 43 and 44. In this embodiment, the contact slice 252 of the conductor terminal 25 of the rotary member 2 is electrically connected with the conductive end 451 of the conductor terminal 45 of the fixing stand 4 through a rivet 26. In addition, the contact slice 252 is allowed to be freely rotated with respect to the rivet 26. It is noted that, however, those skilled in the art will readily observe that numerous modifications and alterations may be made while retaining the teachings of the invention. For example, in some embodiments, the contact slice 252 of the conductor terminal 25 of the rotary member 2 is formed as a clamp (as shown in FIG. 5B). Corresponding to the clamp, the conductive end 451 of the conductor terminal 45 of the fixing stand 4 is formed as a conductive rod. After the conductive rod is penetrated through the perforation 223 of the bottom cover 22 (as shown in FIGS. 2 and 3), the conductive rod is inserted to the clamping space of the clamp, so that the conductor terminal 25 and the conductor terminal 45 are electrically connected with each other. At the same time, the contact slice 252 (clamp) is allowed to be freely rotated with respect to conductive end 451 (conductive rod).

Figure 6:
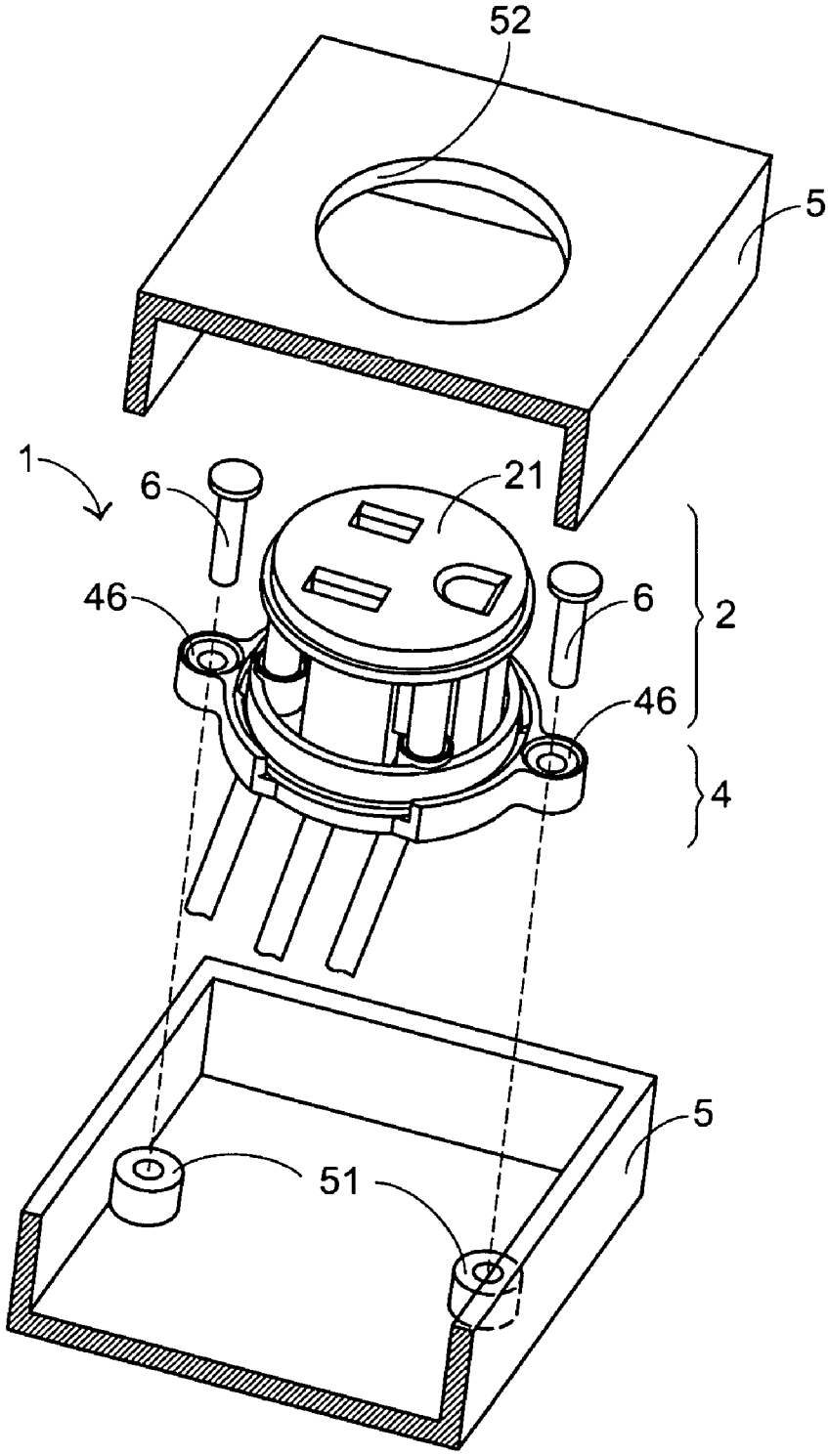
FIG. 6 is a schematic exploded view illustrating the combination of the rotatable receptacle of the present invention and a casing.

In the above embodiments, the rotatable receptacle 1 is illustrated by referring to a three-hole receptacle. The rotatable receptacle 1 is not limited to the three-hole receptacle. For example, in some embodiments, the rotatable receptacle 1 is a two-hole receptacle. Nevertheless, the concepts of the present invention can be applied to various commercially available receptacles, such as Type A sockets, Type B sockets, Type C sockets, Type D sockets, Type E sockets, Type F sockets, Type E/F hybrid sockets, Type G sockets, Type H sockets, Type I sockets, Type J sockets, Type K sockets, Type L sockets, Type M, Stage Pin Connector, Multi-standard sockets, or Proposed common standard sockets. Moreover, in the rotatable receptacle 1 of the present invention, the conductor terminals communicated with the insertion holes are protruded out of the bottom cover 22. As shown in FIGS. 4B and 6, after the resilient sustaining slice 232 of the conductor terminal 23 and the resilient sustaining slice 242 of the conductor terminal 24 are protruded out of the bottom cover 22, the distance between the resilient sustaining slice 232 and the rotating axle 28 of the rotary member 2 is different from the distance between the resilient sustaining slice 242 and the rotating axle 28. In other words, the resilient sustaining slices of different conductor terminals are located at different rotating tracks. When the rotary member 2 is rotated with respect to the fixing stand 4, the conductor terminals of the rotary member 2 are continuously contacted with and electrically with corresponding ring-shape contact regions of the fixing stand 4.

FIG. 6 is a schematic exploded view illustrating the combination of the rotatable receptacle of the present invention and a casing. As shown in FIG. 6, several fastening holes 46 are formed in the fixing stand 4. Corresponding to the fastening holes 46, several studs 51 (or bolt holes) are formed on the casing 5. By penetrating screws 6 through the fastening holes 46 and then tightening the screws 6 in the studs 51, the rotary member 2 and the fixing stand 4 are fixed within the casing 5. Moreover, the casing 5 has a perforation 52. The size of the perforation 52 mates with the outer cover 21 of the rotary member 2. After the rotatable receptacle is fixed within the casing 5, the outer cover 21 of the rotary member 2 is exposed through the perforation 52.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotatable receptacle comprising:

a rotary member comprising:

an outer cover including a faceplate side and an internal side, wherein said faceplate side includes a first insertion hole and a second insertion hole, said internal side includes a first recess and a second recess, said first insertion hole is communicated with said first recess, and said second insertion hole is communicated with said second recess;

a bottom cover fixed onto said internal side of said outer cover, and including a first perforation and a second perforation, wherein said bottom cover has a protruding edge on a periphery thereof;

a first conductor terminal arranged between said outer cover and said bottom cover, and including a first contact slice and a first resilient sustaining slice, wherein said first contact slice is inserted into said first recess, and said first resilient sustaining slice is penetrated through said first perforation and protruded out of said bottom cover; and a second conductor terminal arranged between said outer cover and said bottom cover, and including a second contact slice and a second resilient sustaining slice, wherein said second contact slice is inserted into said second recess, and said second resilient sustaining slice is penetrated through said second perforation and protruded out of said bottom cover;

a power cord comprising a first polarity wire and a second polarity wire; and a fixing stand comprising:

a side wall having a hooking element engaged with said protruding edge of said bottom cover, so that said rotary member is rotatable with respect to said fixing stand;

a bottom surface;

a first conductor slice electrically connected with said first polarity wire, and including a third perforation and a first ring-shape contact region, wherein said first ring-shape contact region is contacted with said first resilient sustaining slice; and a second conductor slice electrically connected with said second polarity wire, accommodated within said third perforation, and including a second ring-shape contact region, wherein said second ring-shape contact region is contacted with said second resilient sustaining slice.

2. The rotatable receptacle according to claim 1 wherein said protruding edge is a ring-shaped protruding structure.

3. The rotatable receptacle according to claim 1 wherein said protruding edge includes multiple annularly-arranged protruding structures.

4. The rotatable receptacle according to claim 1 further including:

a stud formed on said internal side of said outer cover;

a fastening hole formed in said bottom cover; and a screw penetrating through said fastening hole and tightening in said stud, thereby fixing said bottom cover onto said internal side of said outer cover.

5. The rotatable receptacle according to claim 1 wherein said bottom surface of said fixing stand further includes:

a first concave region for accommodating said first conductor slice; and a second concave region for accommodating said second conductor slice.

6. The rotatable receptacle according to claim 1 wherein said bottom surface of said fixing stand further includes:

a fourth perforation, wherein said first polarity wire is penetrated through said fourth perforation and electrically connected with said first conductor slice; and a fifth perforation, wherein said second polarity wire is penetrated through said fifth perforation and electrically connected with said second conductor slice.

7. The rotatable receptacle according to claim 1 wherein said first polarity wire is one of a live wire and a neutral wire, and said second polarity wire is the other of said live wire and said neutral wire.

8. The rotatable receptacle according to claim 1 wherein partial surface of said first conductor slice is formed as said first ring-shape contact region, and partial surface of said second conductor slice is formed as said second ring-shape contact region.

9. A rotatable receptacle comprising:

a rotary member comprising:

an outer cover including a faceplate side and an internal side, wherein said faceplate side includes a first insertion hole, a second insertion hole and a third insertion hole, said internal side includes a first recess, a second recess and a third recess, said first insertion hole is communicated with said first recess, said second insertion hole is communicated with said second recess, and said third insertion hole is communicated with said second recess;

a bottom cover fixed onto said internal side of said outer cover, and including a first perforation, a second perforation and a third perforation, wherein said bottom cover has a protruding edge on a periphery thereof;

a first conductor terminal arranged between said outer cover and said bottom cover, and including a first contact slice and a first resilient sustaining slice, wherein said first contact slice is inserted into said first recess, and said first resilient sustaining slice is penetrated through said first perforation and protruded out of said bottom cover;

a second conductor terminal arranged between said outer cover and said bottom cover, and including a second contact slice and a second resilient sustaining slice, wherein said second contact slice is inserted into said second recess, and said second resilient sustaining slice is penetrated through said second perforation and protruded out of said bottom cover; and a third conductor terminal arranged between said outer cover and said bottom cover, and including a third contact slice and a fourth contact slice, wherein said third contact slice is inserted into said third recess;

a power cord comprising a first polarity wire, a second polarity wire and a third polarity wire; and a fixing stand comprising:

a side wall having a hooking element engaged with said protruding edge of said bottom cover, so that said rotary member is rotatable with respect to said fixing stand;

a bottom surface having a fourth insertion hole;

a first conductor slice electrically connected with said first polarity wire, and including a fourth perforation and a first ring-shape contact region, wherein said first ring-shape contact region is contacted with said first resilient sustaining slice;

a second conductor slice electrically connected with said second polarity wire, accommodated within said fourth perforation, and including a fifth perforation and a second ring-shape contact region, wherein said second ring-shape contact region is contacted with said second resilient sustaining slice; and a fourth conductor terminal accommodated within said fifth perforation, and including a conductive end and an inserting slice, wherein said conductive end is electrically connected to the fourth contact slice, and said inserting slice is penetrated through said fourth insertion hole and protruded out of said fixing stand to be electrically connected with said third polarity wire.

10. The rotatable receptacle according to claim 9 wherein said conductive end of said fourth conductor terminal is connected with said fourth contact slice of said third conductor terminal through a rivet.

11. The rotatable receptacle according to claim 9 wherein said fourth contact slice of said third conductor terminal is formed as a clamp, and said conductive end of said fourth conductor terminal is formed as a conductive rod, which is penetrated through said third perforation and inserted into said clamp.

12. The rotatable receptacle according to claim 9 wherein said protruding edge is a ring-shaped protruding structure.

13. The rotatable receptacle according to claim 9 wherein said protruding edge includes multiple annularly-arranged protruding structures.

14. The rotatable receptacle according to claim 9 further including:

a stud formed on said internal side of said outer cover;

a fastening hole formed in said bottom cover; and a screw penetrating through said fastening hole and tightening in said stud, thereby fixing said bottom cover onto said internal side of said outer cover.

15. The rotatable receptacle according to claim 9 wherein said bottom surface of said fixing stand further includes:

a first concave region for accommodating said first conductor slice; and a second concave region for accommodating said second conductor slice.

16. The rotatable receptacle according to claim 9 wherein said bottom surface of said fixing stand further includes:

a sixth perforation, wherein said first polarity wire is penetrated through said sixth perforation and electrically connected with said first conductor slice; and a seventh perforation, wherein said second polarity wire is penetrated through said seventh perforation and electrically connected with said second conductor slice.

17. The rotatable receptacle according to claim 9 wherein said first polarity wire is selected from one of a live wire, a neutral wire, and an earth wire.

18. The rotatable receptacle according to claim 9 wherein said second polarity wire is selected from one of a live wire, a neutral wire, and an earth wire.

19. The rotatable receptacle according to claim 9 wherein said third polarity wire is selected from one of a live wire, a neutral wire, and an earth wire.

20. The rotatable receptacle according to claim 9 wherein partial surface of said first conductor slice is formed as said first ring-shape contact region, and partial surface of said second conductor slice is formed as said second ring-shape contact region.

* * * * *